US008708531B2

(12) United States Patent
Joung et al.

(10) Patent No.: US 8,708,531 B2
(45) Date of Patent: Apr. 29, 2014

(54) ILLUMINATION APPARATUS INCLUDING LIGHT-EMITTING DEVICE

(75) Inventors: Wuk-chul Joung, Seoul (KR); Jin-woo Bae, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 161 days.

(21) Appl. No.: 13/238,596

(22) Filed: Sep. 21, 2011

(65) Prior Publication Data

US 2012/0188762 A1 Jul. 26, 2012

(30) Foreign Application Priority Data

Jan. 25, 2011 (KR) ..... 10-2011-0007318

(51) Int. Cl.
*F21V 29/00* (2006.01)

(52) U.S. Cl.
USPC ..... 362/294; 362/373; 362/311.02; 362/455

(58) Field of Classification Search
USPC ..... 362/294, 373, 249.02, 311.02, 235, 362/311.01, 455
See application file for complete search history.

(56) References Cited

U.S. PATENT DOCUMENTS

2003/0131941 A1 7/2003 Baggett et al.
2006/0227558 A1* 10/2006 Osawa et al. ..... 362/351
2008/0130308 A1 6/2008 Behr et al.
2009/0161356 A1 6/2009 Negley et al.
2010/0328956 A1 12/2010 Zhang

FOREIGN PATENT DOCUMENTS

| | | | |
|---|---|---|---|
| DE | 20 2010 009 679 | U1 | 9/2010 |
| EP | 2 442 012 | A1 | 4/2012 |
| JP | 2004-206947 | A | 7/2004 |
| JP | 2008-198618 | | 8/2008 |
| KR | 10-2008-0098762 | A | 11/2008 |
| WO | 2010/143577 | A1 | 12/2010 |

OTHER PUBLICATIONS

Extended European Search Report issued in European Patent Application No. EP 11181169.1 dated Dec. 17, 2012.
European Examination Report issued in European Patent Application No. EP 11 181 169.1 dated Nov. 27, 2013.

* cited by examiner

*Primary Examiner* — Thomas Sember
(74) *Attorney, Agent, or Firm* — McDermott Will & Emery LLP

(57) ABSTRACT

A light-emitting device illumination apparatus includes a housing having a barrier wall that defines a first space and a second space in the housing; a light-emitting device module disposed on a first surface of the barrier wall and including a printed circuit board (PCB) disposed on the first surface and a plurality of light-emitting device chips disposed on the PCB; and a power supplier disposed on a second surface of the barrier wall, the second surface facing the first surface, and for applying a voltage to the light-emitting device module.

17 Claims, 3 Drawing Sheets

ILLUMINATION APPARATUS INCLUDING LIGHT-EMITTING DEVICE

CROSS-REFERENCE TO RELATED APPLICATIONS

This application claims the benefit of Korean Patent Application No. 10-2011-0007318, filed on Jan. 25, 2011, in the Korean Intellectual Property Office, the disclosure of which is incorporated herein in its entirety by reference.

BACKGROUND

1. Field

The present disclosure relates to illumination apparatuses including a plurality of light-emitting devices.

2. Description of the Related Art

A light-emitting device such as a light-emitting diode (LED) is a semiconductor device that can realize light of various colors via a light source formed through a PN junction of compound semiconductors. Recently, blue light-emitting diodes and ultra violet (UV) light-emitting diodes, which are formed of nitrides with excellent physical and chemical properties, have been introduced, and white light or monochromatic light has been realized by using blue or UV light-emitting diodes and fluorescent materials, thereby improving the applicability range of light-emitting diodes.

An LED has a long lifetime, can be miniaturized and made lightweight, and can be driven at a low voltage due to its strong directivity of light. In addition, since the LED is resistant to impact and vibration, does not require a warm-up time and complicated driving, and can be packaged in various forms, the LED can be widely used.

For example, an LED can be used in an illumination apparatus. As an LED outputs high power light, a heat dissipation member, for example, a heat sink is required. In a typical LED illumination apparatus, since a heat sink and a light-emitting module are integrated with each other, the size of the heat sink is limited. Thus, it is difficult to satisfy the heat dissipating requirement of an illumination apparatus using high output LED.

SUMMARY

Provided are illumination apparatuses including light-emitting devices, in which a light-emitting device module and a heat dissipation member (a heat sink) are independently installed.

Additional aspects will be set forth in part in the description which follows and, in part, will be apparent from the description, or may be learned by practice of the presented embodiments.

According to an aspect of the present invention, an illumination apparatus includes a housing having a barrier wall that defines a first space and a second space in the housing; a light-emitting device module disposed on a first surface of the barrier wall and including a printed circuit board (PCB) disposed on the first surface and a plurality of light-emitting device chips disposed on the PCB; and a power supplier disposed on a second surface of the barrier wall, the second surface facing the first surface, and for applying a voltage to the light-emitting device module.

The housing may include a metal.

The illumination apparatus may further include a metal plate disposed under the PCB.

The illumination apparatus may further include a heat dissipation member that contacts a lower surface of the housing and covers the second space.

The illumination apparatus may further include a thermal interface material coated between the metal plate and the barrier wall.

The illumination apparatus may further include a heat sink connected to a lower surface of the heat dissipation member.

A lower surface of the heat dissipation member and an upper surface of the heat sink may be connected to each other.

The illumination apparatus may further include a thermal interface material coated between the lower surface of the heat dissipation member and the upper surface of the heat sink.

The power supplier may include a terminal that extends through a lateral wall of the housing and is connected to an external power source.

The barrier wall may include a metal, and the housing and the barrier wall may be integrally formed with each other.

The illumination apparatus may further include a diffuser that is disposed on the housing, covers the first space, and uniformly diffuses light emitted from the light-emitting device module.

The illumination apparatus may further include a fixing member for fixing the diffuser to the housing.

The housing may have a cylindrical shape.

The second space may be greater than the first space.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
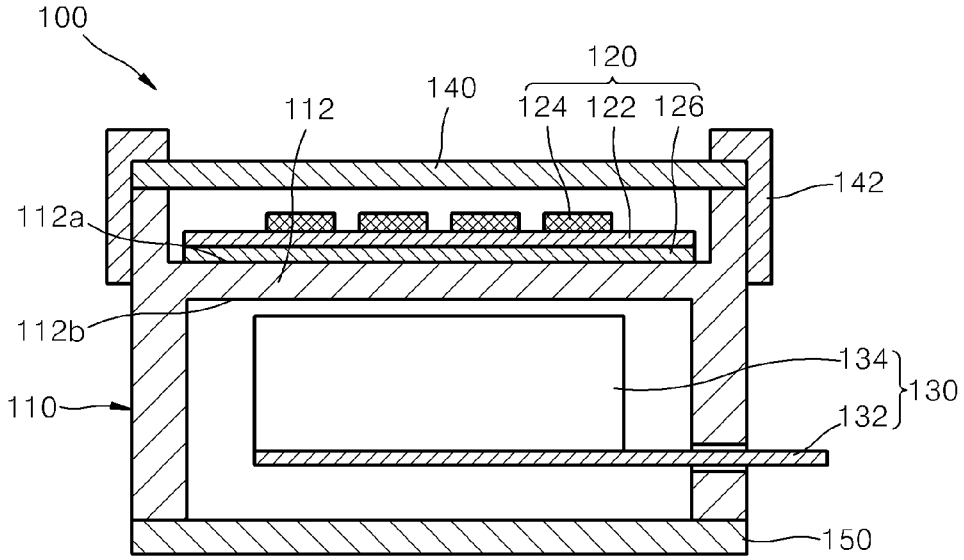
FIG. 1 is a cross-sectional view of an illumination apparatus including a light-emitting device, according to an embodiment of the present invention.

Hereinafter, an illumination apparatus including a light emitting device will be described with regard to exemplary embodiments of the invention with reference to the attached drawings. In the drawings, the thicknesses of layers and regions are exaggerated for clarity. Like reference numerals in the drawings denote like elements, and thus their description will be omitted.

Figure 2:
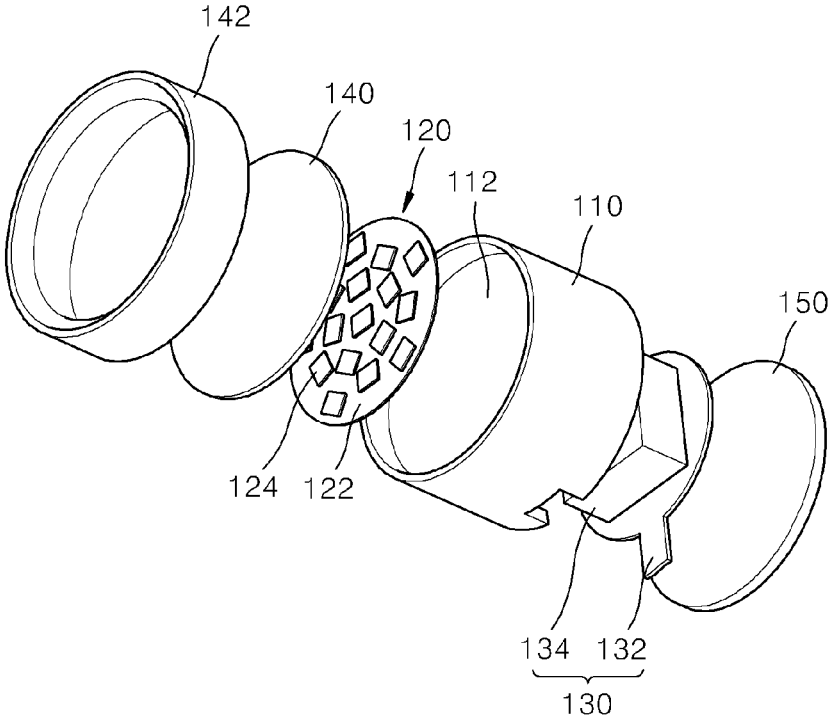
FIG. 2 is a schematic exploded view of the light-emitting device illumination apparatus of FIG. 1, according to an embodiment of the present invention.

FIG. 1 is a cross-sectional view of an illumination apparatus 100 including a light-emitting device, according to an embodiment of the present invention. FIG. 2 is a schematic exploded view of the light-emitting device illumination apparatus 100 of FIG. 1, according to an embodiment of the present invention.

Referring to FIGS. 1 and 2, the light-emitting device illumination apparatus 100 includes a housing 110 having a cylindrical shape. The housing 110 may be formed of a thermal conductive material, that is, a metal with high thermal conductivity. For example, the housing 110 may be formed of aluminum (Al).

A barrier wall 112 that divides the housing 110 into two spaces is formed in the housing 110. The barrier wall 112 may be formed of a metal material. The barrier wall 112 may be integrally formed with the housing 110. The housing 110 is divided into a first space corresponding to a first surface 112*a* of the barrier wall 112 and a second space corresponding to a second surface 112*b* that faces the first surface 112*a*.

A light-emitting device module 120 is disposed on the first surface 112*a*. The light-emitting device module 120 includes a printed circuit board (PCB) 122 and a plurality of light-emitting device chips 124 that are disposed on the PCB 122 and are electrically connected to the PCB 122. A metal plate 126, for example, an Al plate is formed on a lower surface of the PCB 122. The metal plate 126 contacts the first surface 112*a*. The PCB 122 and the metal plate 126 may form a single structure that may be referred to as a metal core PCB. In FIG. 2, for convenience of illustration, the metal plate 126 is not illustrated.

The light-emitting device chips 124 may be mounted directly on the PCB 122, or alternatively, may be formed in a package form and then may be mounted on the PCB 122. The light-emitting device chips 124 may each be a light-emitting diode chip including a positive (+) electrode and a negative (−) electrode. The light-emitting diode chip may emit blue light, green light, red light and the like according to a material used to form the light-emitting diode chip. Furthermore, a fluorescence material may be coated on a surface of the light-emitting diode chip so as to emit white light. For example, a blue light-emitting diode chip may include a plurality of active layers with a quantum well layer structure formed by alternately forming GaN and InGaN. In addition, a P-type clad layer and an N-type clad layer, which are formed of a compound semiconductor of $Al_XGa_YN_Z$, may be formed on upper and lower surfaces of the active layers, respectively. According to the present embodiment, the light-emitting device chips 124 are each a light-emitting diode chip, but is not limited thereto. For example, the light-emitting device chips 124 may each be an ultra violet (UV) photodiode chip, a laser diode chip, an organic light-emitting diode chip, or the like.

Figure 3:
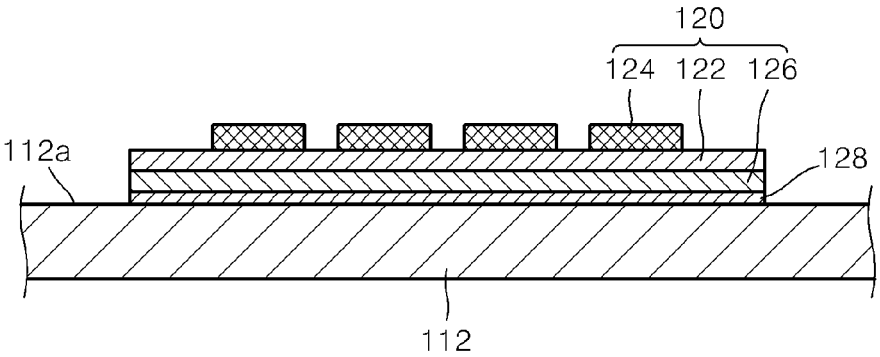
FIG. 3 is a cross-sectional view of a magnified portion of the light-emitting device illumination apparatus of FIG. 1, according to an embodiment of the present invention

FIG. 3 is a cross-sectional view of a magnified portion of the light-emitting device illumination apparatus 100 of FIG. 1, according to an embodiment of the present invention.

Referring to FIG. 3, a thermal interface material 128 may be coated between the metal plate 126 and the first surface 112*a*. In FIGS. 1 and 2, for convenience of illustration, the thermal interface material 128 is not illustrated. The thermal interface material 128 increases the thermal transfer efficiency between the metal plate 126 and the first surface 112*a*. The thermal interface material 128 may be a thermal grease such as silicon oil including a filler such as an Al oxide filler, a zinc oxide filler, or the like.

Referring to FIGS. 1 and 2, a power supplier 130 is disposed in the second space. The power supplier 130 may include a terminal 132 to which external power is input, and a power controller 134 for controlling power supplied to the light-emitting device module 120. The power controller 134 may include, for example, a fuse for shielding an overcurrent, and an electromagnetic shielding filter for shielding electromagnetic interference signals. If alternating current (AC) power is to be input to the terminal 132, the power supplier 130 may include an AC-DC converter, and a voltage controller for converting an input voltage to a voltage appropriate for the light-emitting device module 120. If the power supplier is a DC power source (e.g., a battery) having a voltage appropriate for the light-emitting device module 120, the converter and the voltage controller may be omitted. A current from the power controller 134 is supplied to the light-emitting device module 120 through a through hole (not shown) formed in the barrier wall 112.

The terminal 132 protrudes through a hole formed in one lateral wall of the housing 110 so as to be connected to an external power source.

A diffuser 140 is disposed on the housing 110. The diffuser 140 is used to diffuse spot circular light emitted from the light-emitting device chips 124. An fixing member 142 may be further disposed on the housing 110 to fix the diffuser 140 to an upper portion of the housing 110. An outer circumference surface of the housing 110 and an inner circumference surface of the fixing member 142 may be screwed to each other. The outer circumference surface of the housing 110 and the inner circumference surface of the fixing member 142 may be coupled to each other via an adhesive.

A heat dissipation member 150 for covering the second space is disposed under the housing 110. The heat dissipation member 150 may be formed of a material with high thermal conductivity, for example, Al.

In order to increase the heat dissipation efficiency, the area of the second space is greater than that of the first space since the area of the first space becomes smaller by installing the light-emitting device module 120 therein in order to effectively transfer heat generated from the light-emitting device module 120 to the housing 110, and a portion of the housing 110 corresponding to the second space is used for installing the power supplier 130 and dissipate heat from the first space outwards while the heat is moving to the heat dissipation member 150.

The heat generated from the light-emitting device module 120 is moved to the heat dissipation member 150 through the barrier wall 112 and the housing 110, which have a high thermal conductivity. Heat from the heat dissipation member 150 may be effectively dissipated by a heat sink (not shown). In particular, the amount of heat generated from the light-emitting device module 120 is calculated, and heat sinks may be designed to effectively dissipate the heat from the light-emitting device module 120 in addition to the heat dissipation member 150.

Figure 4:
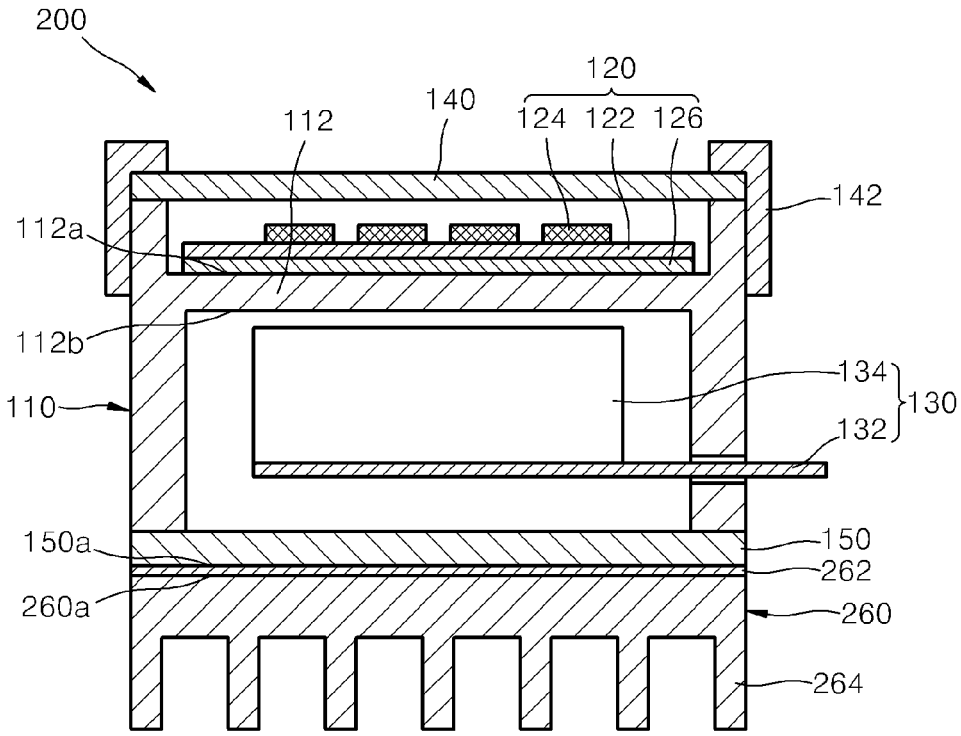
FIG. 4 is a cross-sectional view of a light-emitting device illumination apparatus according to another embodiment of the present invention.

FIG. 4 is a cross-sectional view of a light-emitting device illumination apparatus 200 according to another embodiment of the present invention. In FIGS. 1 and 4, like reference numerals denote like elements, and thus their description will be omitted.

The light-emitting device illumination apparatus 200 includes a heat sink 260 that contacts the heat dissipation member 150 disposed under the housing 110 so as to dissipate heat outwards. The heat sink 260 includes an upper surface 260*a* that contacts a lower surface 150*a* of the heat dissipation member 150. A thermal interface material 262 may be further coated between the upper surface 260*a* of the heat sink 260 and the lower surface 150*a* of the heat dissipation member 150. The thermal interface material 262 increases the thermal transfer efficiency between the heat dissipation member 150 and the heat sink 260. The thermal interface material 262 may be a thermal grease such as silicon oil including a filler such as an Al oxide filler, a zinc oxide filler, or the like.

A plurality of fins 264 may be further formed under the heat sink 260 in order to increase an area for dissipating heat. The heat sink 260 having various shapes may be formed to thermally contact the heat dissipation member 150 so as to dissipate the heat generated from the light-emitting device module 120.

As described above, according to the one or more of the above embodiments of the present invention, a light-emitting device illumination apparatus includes a light-emitting device module generating heat and a heat dissipation member including heat sink for dissipating heat, which are separately designed, and the light-emitting device module and the heat dissipation member are connected by a thermal conductive housing, thereby obtaining an effective design for proper heat dissipation.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. An illumination apparatus, comprising:

a housing comprising a barrier wall that defines a first space and a second space in the housing;

a light-emitting device module disposed on the first surface of the barrier wall and comprising a printed circuit board (PCB) disposed on the first surface and a plurality of light-emitting device chips disposed on the PCB;

a power supplier disposed on a second surface of the barrier wall, and configured to apply a voltage to the light-emitting device module;

a diffuser disposed on the housing and covering the first space; and a fixing member configured to fix the diffuser to the housing such that an outer circumference surface of the housing and an inner circumference surface of the fixing member are engaged with each other.

2. The illumination apparatus of claim 1, wherein the housing comprises a thermal conductive material.

3. The illumination apparatus of claim 1, wherein the housing comprises a metal.

4. The illumination apparatus of claim 3, further comprising a metal plate disposed under the PCB.

5. The illumination apparatus of claim 4, further comprising a thermal interface material coated between the metal plate and the barrier wall.

6. The illumination apparatus of claim 3, further comprising a heat dissipation member that contacts a lower surface of the housing and covers the second space.

7. The illumination apparatus of claim 6, further comprising a heat sink connected to a lower surface of the heat dissipation member.

8. The illumination apparatus of claim 7, wherein the lower surface of the heat dissipation member and an upper surface of the heat sink are connected to each other.

9. The illumination apparatus of claim 8, further comprising a thermal interface material coated between the lower surface of the heat dissipation member and the upper surface of the heat sink.

10. The illumination apparatus of claim 3, wherein the barrier wall comprises a metal.

11. The illumination apparatus of claim 10, wherein the housing and the barrier wall are integrally formed with each other.

12. The illumination apparatus of claim 1, wherein the power supplier comprises a terminal that extends through a lateral wall of the housing and is connected to an external power source.

13. The illumination apparatus of claim 1, wherein the diffuser uniformly diffuses light emitted from the light-emitting device module.

14. The illumination apparatus of claim 1, wherein the housing has a cylindrical shape.

15. The illumination apparatus of claim 1, wherein an area of the second space is greater than an area of the first space.

16. The illumination apparatus of claim 1, wherein an inner surface of the fixing member is disposed on an upper surface of the diffuser.

17. The illumination apparatus of claim 1, wherein the diffuser has a shape of a circular plate.

* * * * *